US012005309B2

(12) United States Patent
Florenca

(10) Patent No.: US 12,005,309 B2
(45) Date of Patent: Jun. 11, 2024

(54) SCALP MUSCLE EXERCISE APPARATUS

(71) Applicant: Isaias Florenca, Hamilton Hill (AU)

(72) Inventor: Isaias Florenca, Hamilton Hill (AU)

( * ) Notice: Subject to any disclaimer, the term of this patent is extended or adjusted under 35 U.S.C. 154(b) by 575 days.

(21) Appl. No.: 17/268,612

(22) PCT Filed: Aug. 20, 2019

(86) PCT No.: PCT/AU2019/050879
§ 371 (c)(1),
(2) Date: Feb. 16, 2021

(87) PCT Pub. No.: WO2020/037365
PCT Pub. Date: Feb. 27, 2020

(65) Prior Publication Data

US 2021/0346757 A1 Nov. 11, 2021

(30) Foreign Application Priority Data

Aug. 20, 2018 (AU) ..... 2018903059

(51) Int. Cl.
*A63B 23/025* (2006.01)
*A63B 21/00* (2006.01)
*A63B 21/02* (2006.01)
*A63B 21/04* (2006.01)

(52) U.S. Cl.
CPC ..... *A63B 23/025* (2013.01); *A63B 21/00069* (2013.01); *A63B 21/026* (2013.01); *A63B 21/0442* (2013.01); *A63B 21/4003* (2015.10); *A63B 21/4025* (2015.10); *A63B 2209/00* (2013.01)

(58) Field of Classification Search
CPC ..... A63B 21/00178; A63B 21/00185; A63B 21/02; A63B 21/026; A63B 21/04; A63B 21/0421; A63B 21/0442; A63B 21/045; A63B 21/0615; A63B 21/065; A63B 21/4003; A63B 21/4025; A63B 21/4047; A63B 23/025
See application file for complete search history.

(56) References Cited

U.S. PATENT DOCUMENTS 4,066,259 A * 1/1978 Brentham ..... A63B 23/025 482/10
4,789,154 A * 12/1988 Mattox ..... A63B 21/0004 482/125
6,432,029 B1 * 8/2002 Almeda ..... A63B 21/00047 482/142
2010/0144492 A1 * 6/2010 Ruan ..... A63B 21/4003 482/10

FOREIGN PATENT DOCUMENTS

CN 204134112 U * 2/2015

* cited by examiner

*Primary Examiner* — Zachary T Moore

(57) ABSTRACT

The disclosure provides an apparatus for exercising muscles of the head and/or neck. The apparatus comprises a harness, and a plate is pivotably connected to the harness. The plate is movable between a collapsed position and an exercise position where a back of the head of the user can engage with the plate. A biasing member biases the plate towards the collapsed position.

21 Claims, 7 Drawing Sheets

SCALP MUSCLE EXERCISE APPARATUS

TECHNICAL FIELD

This disclosure relates generally to an exercising apparatus for strengthening the muscles of the scalp.

BACKGROUND

Drooping eyelids is a condition where the border of the upper eyelid, just below the eyebrow, falls to a position that is lower than normal. Drooping eyelid can get so severe that it may cover all or part of the pupil and interfere with vision. Also, sagging skin from drooping eyelids can become very heavy and may create headaches due to the eye muscles overworking to keep the eye open properly during the day. Drooping eyelids also may give the appearance that a person is tired or much older than they really are. The main cause of drooping eyelid condition is the weakening of the epicranius muscle.

Droopy eyelid condition is generally an age-related condition. When a person is young, the body regularly produces human growth hormones (HGH) which helps to keep the muscles of the entire human body strong and the skin tight and thick. As a person ages into adulthood, HGH production reduces, which weakens the muscles and causes the skin to weaken, wrinkle and sag. One way to strengthen the muscles and keep the muscles and skin tight is with resistance exercising.

A host of exercise machines and devices have been created to strengthen and firm muscles of the body, but few exercise devices have been created to exercise and firm the muscles of the scalp. So, while a person can maintain a strong firm body by resistance exercising, the muscles of the scalp are neglected and begin to weaken and sag. This weakening of the scalp muscles directly affects the facial muscles, which are connected to the frontalis muscle which is a part of the epicranius and causes them to weaken and sag thus creating drooping eyelids.

A variety of remedies have been developed in an attempt to treat the condition of drooping eyelids. However, none of these remedies actually targets the core problem of weakening epicranius muscle to solve this condition before it arises. For example, the "Dream Look Instant Eye Lift" is an invisible ultra-thin adhesive eye strip that you apply on drooping eyelids. Apart from being uncomfortable and irritating, these adhesive strips have to be changed daily, can look uneven, can come unstuck while wearing them, and can be seen by the naked eye. This remedy is cosmetic, temporary and does not address the main cause of droopy eyelids. Botox injections can also be used to treat droopy eyelids, but achieves partial results, is only temporary, and is often expensive and may cause serious side effects. Surgery can be used to remove most of the excess fat and sagging skin on the eyelid and to improve vision. However, surgery is a temporary solution because it does not address the core problem of drooping eyelids and the eyelids will continue to droop after the procedure.

It is to be understood that, for any prior art reference referred to herein, such reference does not constitute an admission that the prior art reference forms a part of the common general knowledge in the art.

SUMMARY

The disclosure provides an apparatus for exercising muscles of the head and/or neck of a user, comprising: a harness configured to fit over a user's head and engaged with an upper portion of the user; a plate pivotably connected to the harness, the plate being movable between a collapsed position and an exercise position where a back of the head of the user can engage with the plate; a biasing member that biases the plate towards the collapsed position. The harness may comprise a support having a pair of extending arms that extend from the support and may also include a brace connected to the support.

The disclosure provides an apparatus for exercising muscles of the head and/or neck of a user, comprising: a support portion having a pair of arms extending from the support; a plate pivotably connected to the support, the plate being movable between a collapsed position and an exercise position where a back of the head of the user can engage with the plate; a biasing member that biases the plate towards the collapsed position; and a brace connected to the support.

In use of an embodiment of the apparatus, the harness (e.g. arms) rest on the shoulders of a user, and a portion of the harness (e.g. the brace) contacts the user's back, and a back of the user's head contacts the plate. The user's heads can then be rotated towards or away from their chin resisting the bias of the biasing member or pushing against the bias of the biasing member. During this movement of the user's head, the harness (e.g. via the brace) may act to brace the apparatus against the forces applied to the plate.

The brace may be pivotably connected to the support so as to be movable between a storage position and a brace position. The brace may extend from the support in a direction along the arms when the brace is in the storage position. The arms may be covered by the plate when the plate is in the collapsed position. The plate may extend along the arms when the plate is in the collapsed position and the brace may extend along the arms when the brace is in the storage position. The plate may abut the arms when the plate is in the collapsed position. The position of the plate in the collapsed position and the brace in the storage position may help to reduce an overall size of the apparatus which may help to make the apparatus more convenient to travel with and to store.

At least a portion of the pair of arms may be spaced apart from one another to define an opening therebetween. The arms may be movable away from one another to change a size (e.g. diameter) of the opening to allow the opening to receive a head of a user, for example, so that, in use, the arms rest on the user's shoulders and chest. Each arm of the pair of arms may comprise an end segment. The end segments may be rigid. The end segments may abut one another to maintain a minimum size of the opening. The end segments may be provided with a locking mechanism to lock the end segments together. The locking mechanism may help to improve the stability of the apparatus in use. In an embodiment, the locking mechanism may comprise: a protrusion extending from one end segment, and a recess provided in the other end segment. The protrusion may have a complementary shape to the recess so that the protrusion can be received in the recess as an interference fit. The locking mechanism is not required in all embodiments. The apparatus may be used by a user with the locking mechanism not being engaged, for example by larger users whose chests are large enough to prevent the end segments from abutting one another and for the locking mechanism to lock.

Each arm of the pair of arms may comprise a resiliently deformable section that allows the arms to be moved away from one another to allow the size of the opening to be increased. Each resiliently deformable section may extend along more than 50% of a length of the arm. The resiliently deformable sections may extend from the support.

In an embodiment, the biasing member is a spring hinge having a first spring leaf and a second spring leaf. The first spring leaf may be connected to the support and the second spring leaf may be connected to the plate, for example to outside surfaces of the support and/or plate. The support may be provided with a first hinge recess that can receive the first spring leaf. The plate may be provided with a second hinge recess that can receive the second spring leaf. The second hinge recess may extend from an edge of the plate along a longitudinal direction of the plate. The first hinge recess may extend from an in-use front surface of the support towards an in-use rear surface of the support.

In an embodiment, the first leaf spring may be removably fixed to the first hinge recess and/or the second leaf spring may be removably fixed to the second hinge recess. The spring hinge may have a spring hinge tension adjuster that allows a tension of the spring hinge to be adjusted. The support may be provided with a channel extending through the support. The channel may have a proximal end positioned near the spring hinge tension adjuster and a distal end opposite the proximal end. A tool, for example an Allan key, may pass through the channel to engage with the spring hinge tension adjuster to adjust the tension of the spring. In an embodiment, the channel is aligned along an axis of the spring hinge.

The arms may extend from opposed edges of the support. The plate may be curved to define a concave region. In use, the back of the head of the user may contact the concave region. The brace may be U-shaped and ends of the U-shape may be pivotably connected to the support. The brace may be received in the support via friction fit.

In an embodiment, the support comprises a connecting recess having a sidewall that extends from a surface of the support towards an opposed surface of the support. One of the sidewall and the brace may be provided with a protrusion and the other of the sidewall and brace may be provided with an indent sized to receive the protrusion. When the protrusion is received in the indent, the brace may be removably attached to the support and may be pivotable about an axis defined by the protrusion. The connecting recess may comprise a region that abuts with the brace when the brace is in the brace position to limit rotation of the brace.

The apparatus may further comprise a second or more plates. For example, the apparatus may comprise a second and a third plate. The plate and the second or more plates may each have a different size. For example, the plates may have a small, medium and large size to accommodate different head sizes.

The disclosure also provides a kit comprising the apparatus as set forth above, and three different sized plates.

BRIEF DESCRIPTION OF FIGURES

Embodiments of the disclosure will now be described by way of example only with reference to the following non-limiting Figures.

DETAILED DESCRIPTION OF EMBODIMENTS

Figure 1:
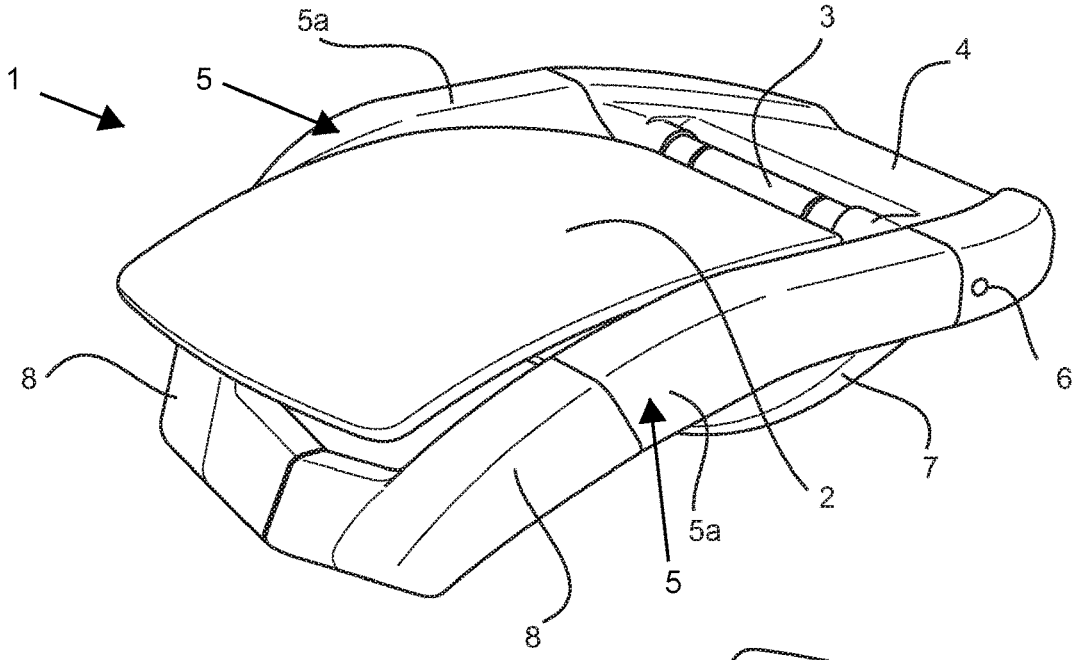
FIG. 1 shows a perspective side elevation of an embodiment of an apparatus in a first configuration.

FIG. 1 shows an embodiment of an apparatus 1 for exercising muscles of the head and/or neck. The apparatus 1 has a support in the form of a stabiliser section 4. Extending from the stabiliser section 4 is a pair of arms 5. In the embodiments shown in the Figures the arms 5 both extend from the same first surface. The first surface is in the form of front surface of the stabiliser section 4. The arms 5 and are positioned at opposed side edges of the stabiliser section 4. An outside surface of each arm is flush with an outside surface of the stabiliser section 4. However, in some embodiments, the arms 5 extend from the stabiliser section 4 at a position inboard from the opposed side edges of the in-use front surface of the stabiliser section 4. In some embodiments the arms are connected to and extend along sides of the stabiliser section 4. The arms 5 rest on the shoulders of a user and are contoured so that distal ends of the arms rest against a chest of the user. The arrangement of the stabiliser section 4 and the arms 5 forms a neck collar that is designed to fit around a neck of a user, where the stabiliser section 4 is arranged to be positioned at the back of the neck and the arms 5 extend on opposite sides of and past the neck.

Figure 2:
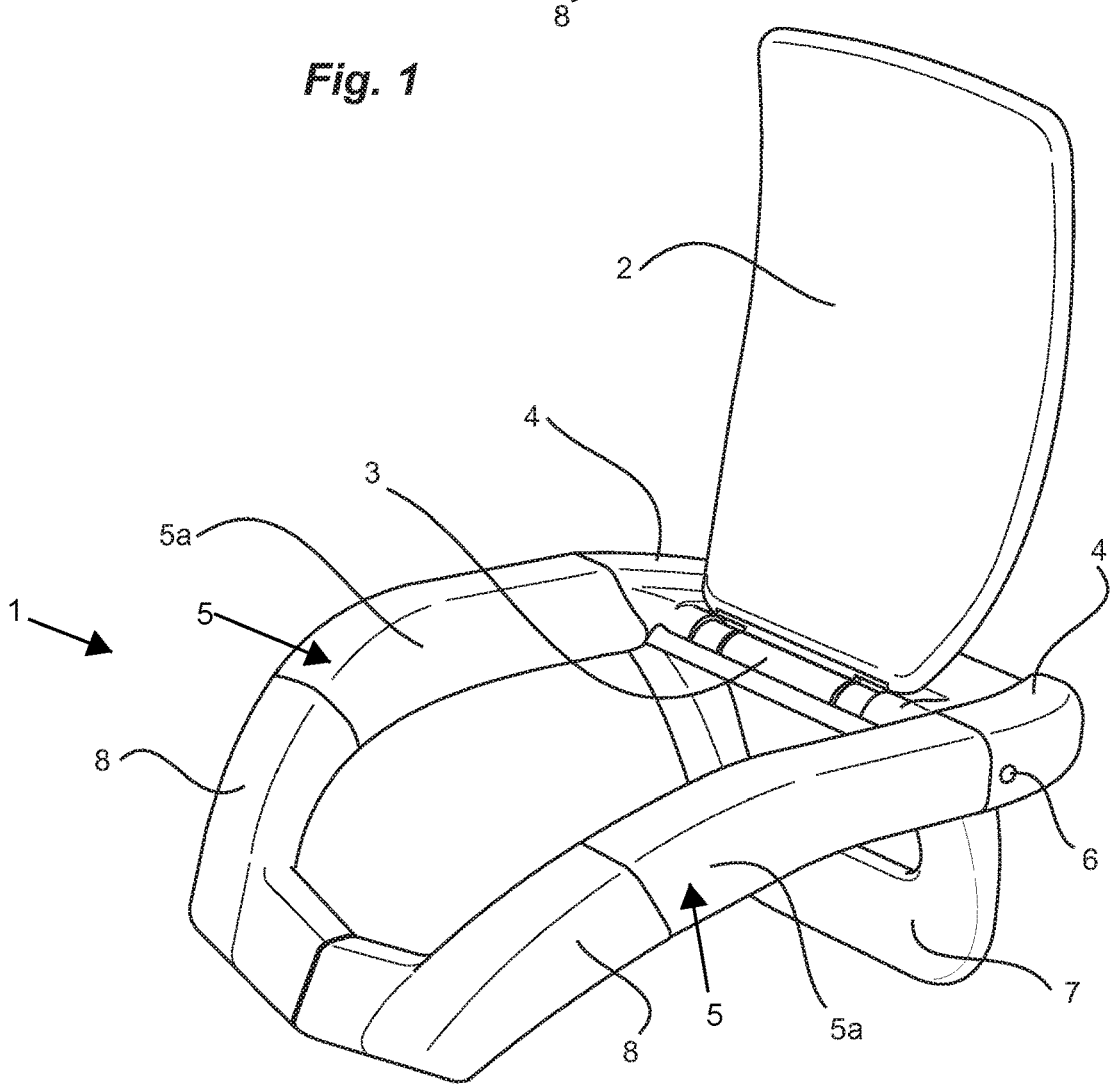
FIG. 2 shows a perspective side elevation of an embodiment of an apparatus in a second configuration.
Figure 3:
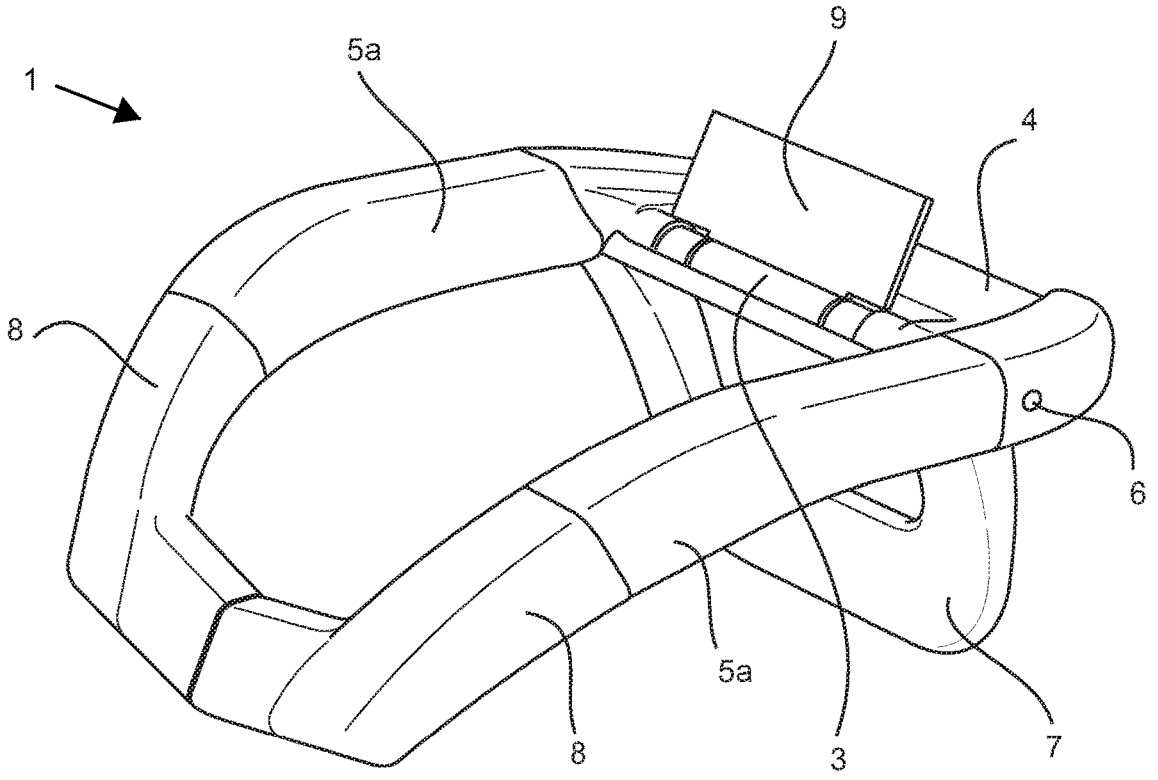
FIG. 3 shows a perspective side elevation of an embodiment of an apparatus in a second configuration.
Figure 5:
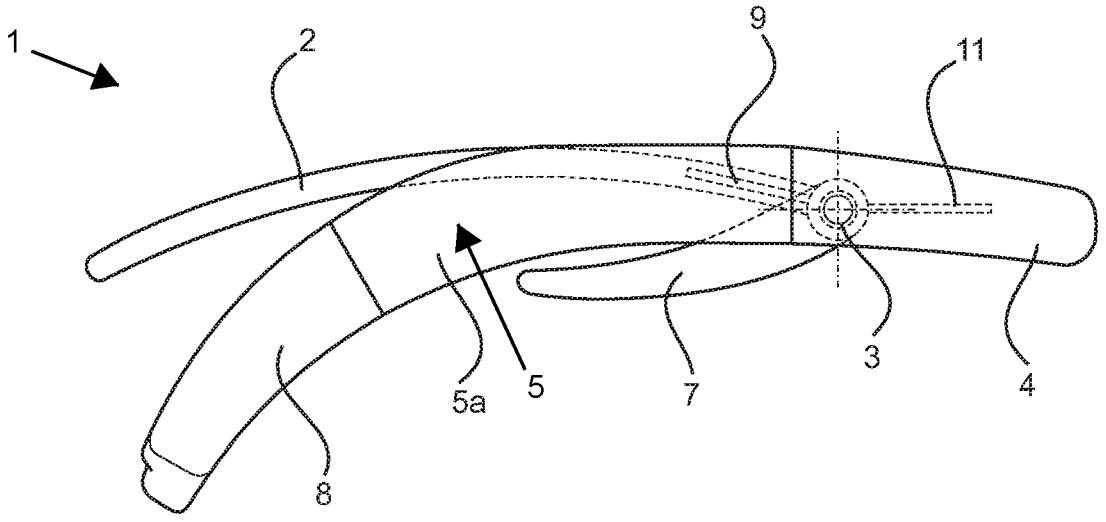
FIG. 5 shows a side view and partial cross-section of FIG. 1.
Figure 6:
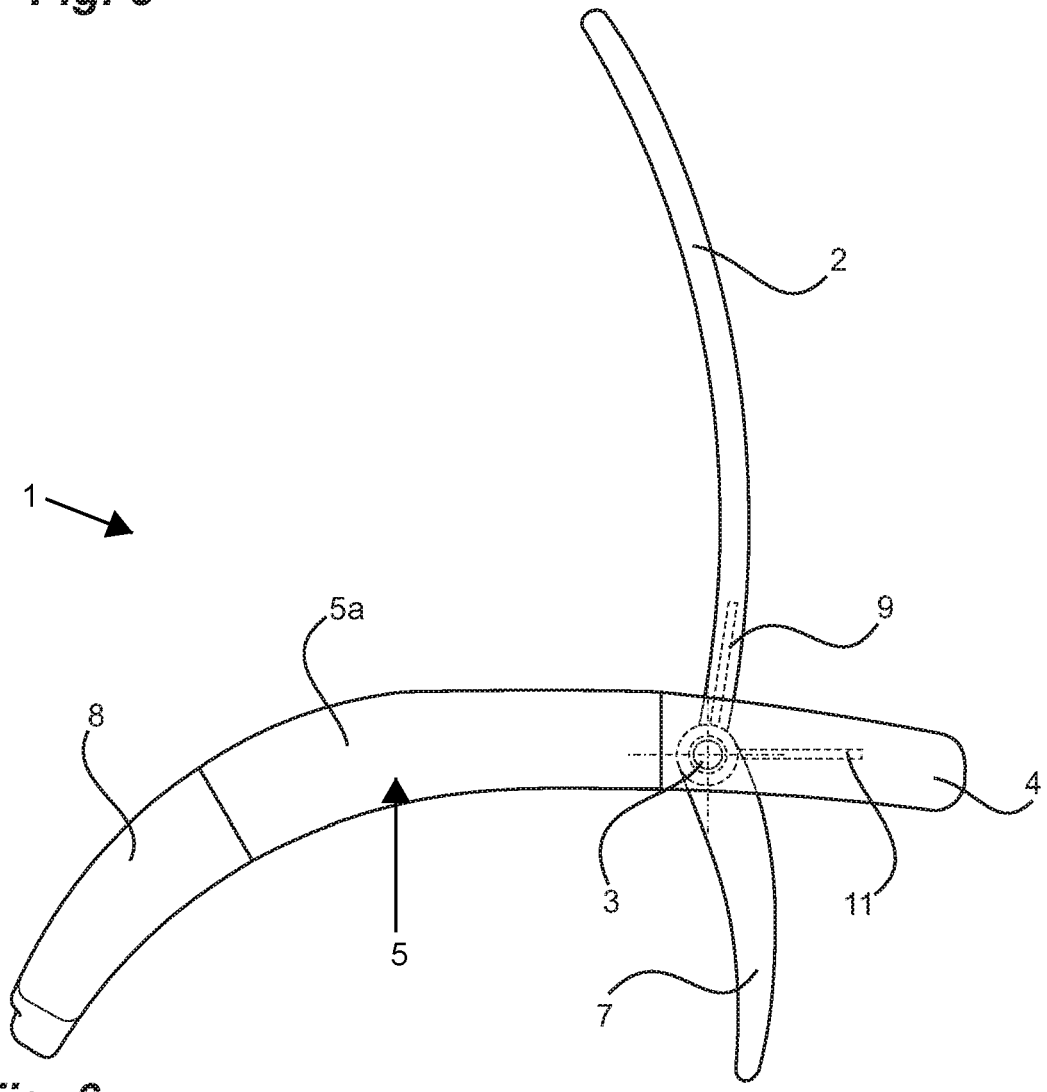
FIG. 6 shows a side view and partial cross-section of FIG. 2.

A biasing member in the form of spring hinge 3 is connected to the stabiliser section 4. The spring hinge 3 is also connected to a plate in the form of headboard 2. The headboard 2 pivots about an axis defined by the spring hinge 3 between a collapsed position, as best shown in FIG. 1 and FIG. 5, and an exercise position, as best shown in FIG. 2 and FIG. 6. In the exercise position, a back section of a head of a user will contact the headboard 2. A torque is applied to the spring hinge 3 via a spring located in a barrel of the spring hinge 3 which biases the headboard 2 towards the collapsed position.

The apparatus 1 also has a brace that in use acts to brace the apparatus 1 against the upper back of a user. In the Figures, the brace is shown as the back support 7. The back support 7 is pivotably mounted to the stabiliser section 4 so that the back support 7 can pivot between a storage position, as best shown in FIG. 1 and FIG. 5, and a brace position, as best shown in FIG. 2 and FIG. 6. The back support 7 is positioned towards an in-use rear side of the stabiliser section 4. Allowing the back support 7 to fold inward from the brace position to the storage position helps to reduce an overall volume of the apparatus 1 which helps in making it more compact and travel friendly. However, in some embodiments the back support 7 is fixed relative the stabiliser section 4 (i.e. is not rotatable).

Figure 7:
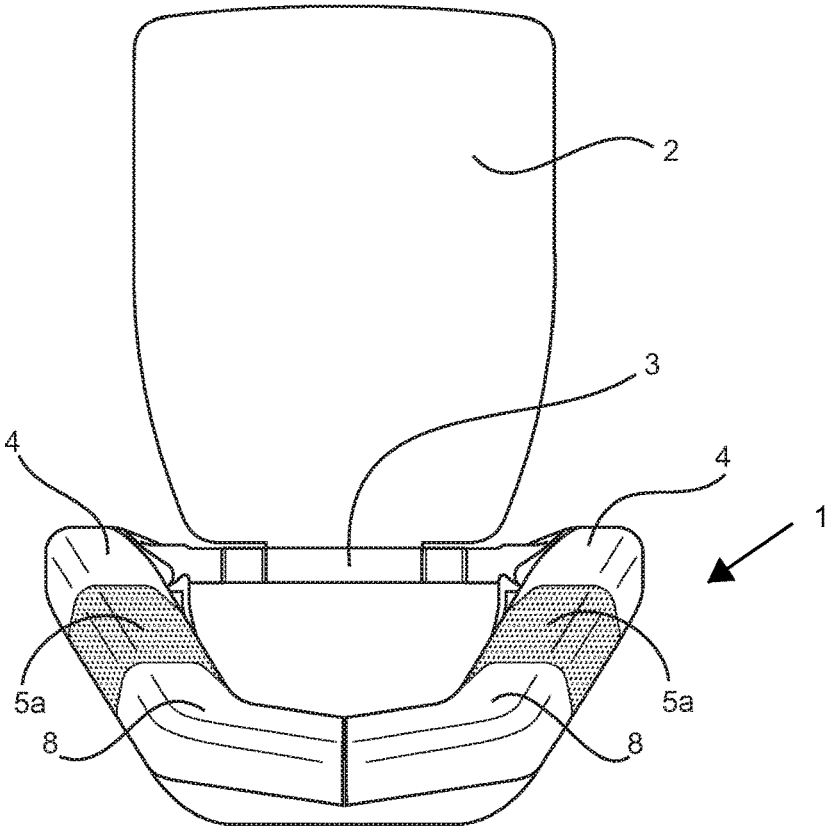
FIG. 7 shows a front view of the configuration shown in FIG. 1.
Figure 8:
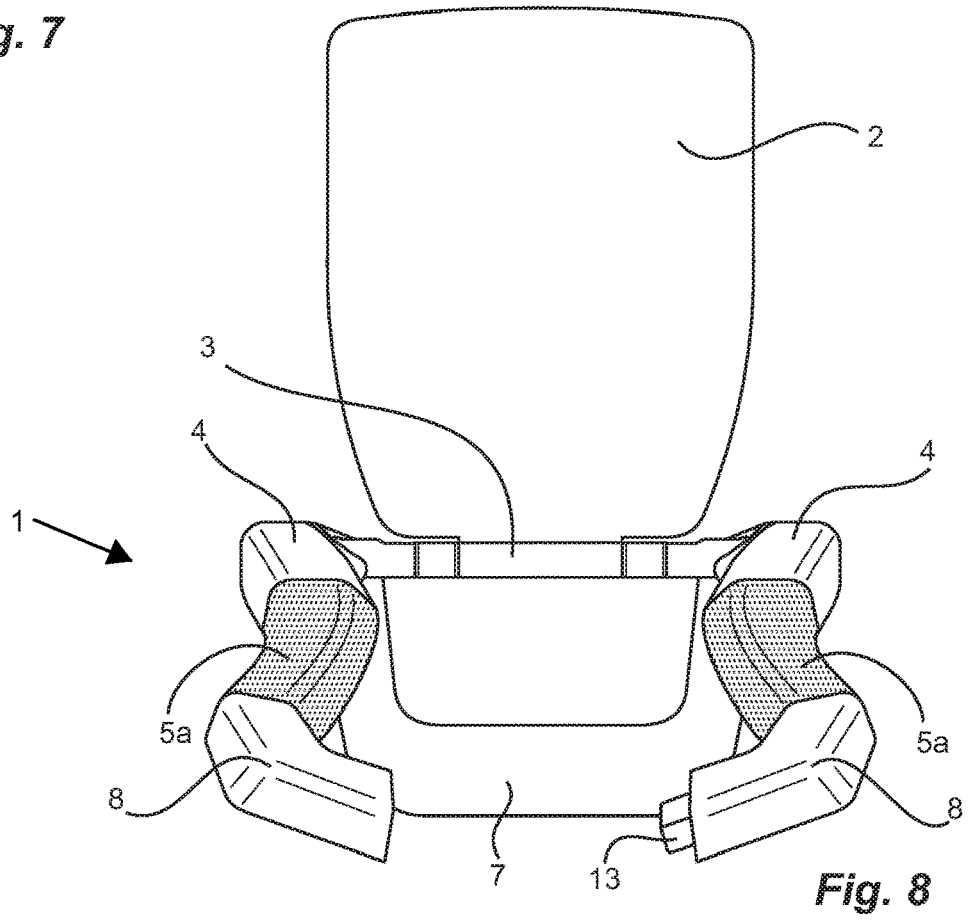
FIG. 8 shows the embodiment of FIG. 7.
Figure 9:
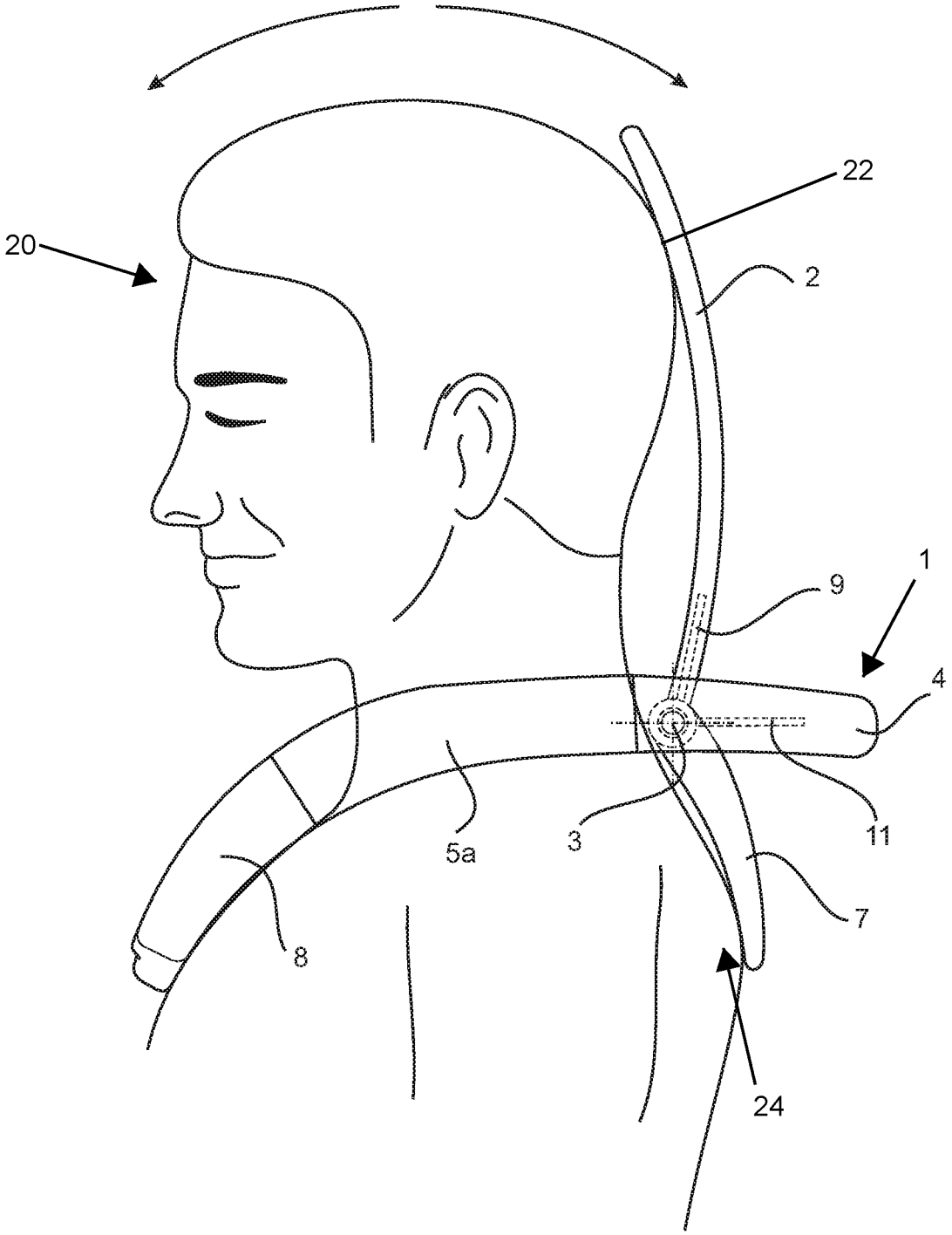
FIG. 9 shows a side view of an embodiment of an apparatus in a start position.

The pair of arms 5 is spaced apart from one another so that an opening is formed therebetween. The opening is sized so that a head of a user can pass through the opening so that the apparatus 1 can rest on the shoulder of the user, as best shown in FIG. 9. In an embodiment, at least a portion of the arms 5 is includes a deformable section 5*a* made from a deformable material or structure. The deformable section 5*a* allows the arms 5 to move away from one another so that a gap size (e.g. a width of the opening) of the opening can be increased, as best seen in FIG. 7 and FIG. 8. For example, when a user is passing their head through the opening formed between the arms 5, having movable arms 5 means that different sized heads can pass through the opening, allowing the apparatus 1 to be used by users with a wide variety of head shapes. In an embodiment, the opening has at its widest point a minimum size of about 150 mm. In an embodiment, the arms 5 can be moved away from each other to increase the size of the opening to about 300 mm. In some embodiments, the size of the opening formed between the arms 5 ranges from about 150 mm to about 300 mm by moving ends of the arms 5 away or towards one another. In an embodiment each arm has a width of about 50 mm and a thickness of about 30 mm. In some embodiments a bevel extends from an inner edge (i.e. the edge of the arm that defines the opening) of each arm down to a contact surface of each arm. The contact surface is the surface that contacts the user's shoulders and chest in use. The contact surface can also be referred to as an underside of the arm.

Each arm 5 has an end segment in the form of arm stabiliser 8. In an embodiment, the arms 5 are formed from a resiliently deformable material, such as rubber, and the arm stabilisers 8 are a rigid cover that encapsulates at least a portion of the resiliently deformable material. For example, in an embodiment, the arm stabilisers 8 are formed from hard plastic that covers an in-use upper portion of the arms 5 so that the contact surface of the arms 5 is not covered by the arm stabilisers 8. Embodiments such as these may help to ensure that the chest and shoulder region of a user only comes into contact with resilient materials that are more comfortable compared to hard plastics. In an embodiment, the resilient deformable section 5*a* occupies more than 50% of a length of the arms. Accordingly, when the arms 5 are provided with the arm stabilisers 8, the arm stabilisers 8 occupy less than 50% of the length of the arms 5.

In the embodiment shown in FIG. 8, one of the arm stabilisers 8 has a protrusion in the form of latch member 13 and the other arm stabiliser 8 has a recess (not shown in the Figures) that is sized to accommodate the latch member 13 via an interference fit. When the latch member 13 is received in the recess, the arm stabilisers 8, and thus the arms 5, are removably fixed to one another. The latch member 13 and recess act as a locking mechanism. Having a locking mechanism can help to maintain a minimum size of the opening. However, the locking mechanism is not required in all embodiments.

In an embodiment, in the collapsed position the headboard 3 extends along a section of the arms 5. In some embodiments, the headboard 3 abuts and rests against the pair of arms 5. Put another way, the arms 5 act as a stop to limit the amount of rotation so that the headboard 3 cannot rotate past the collapsed position shown in FIG. 1 and FIG. 5. In the collapsed position, the headboard 2 covers the opening formed between the pair of arms 5. In the storage position the back support 7 extends away from the stabiliser section 4 generally in the same direction as the arms 5.

Figure 10:
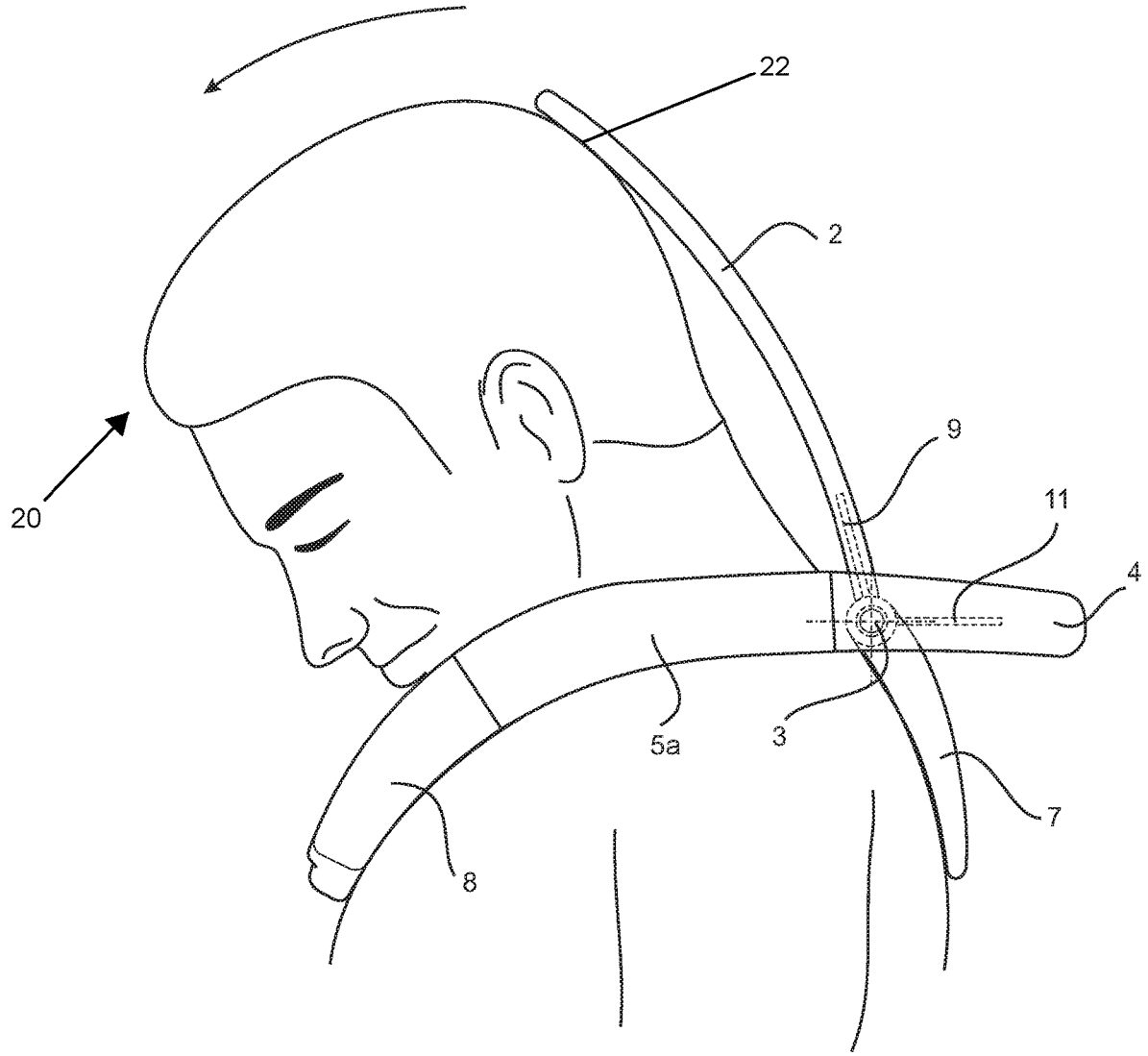
FIG. 10 shows a side view of the apparatus shown in FIG. 9 but now in a neck stretching position.
Figure 11:
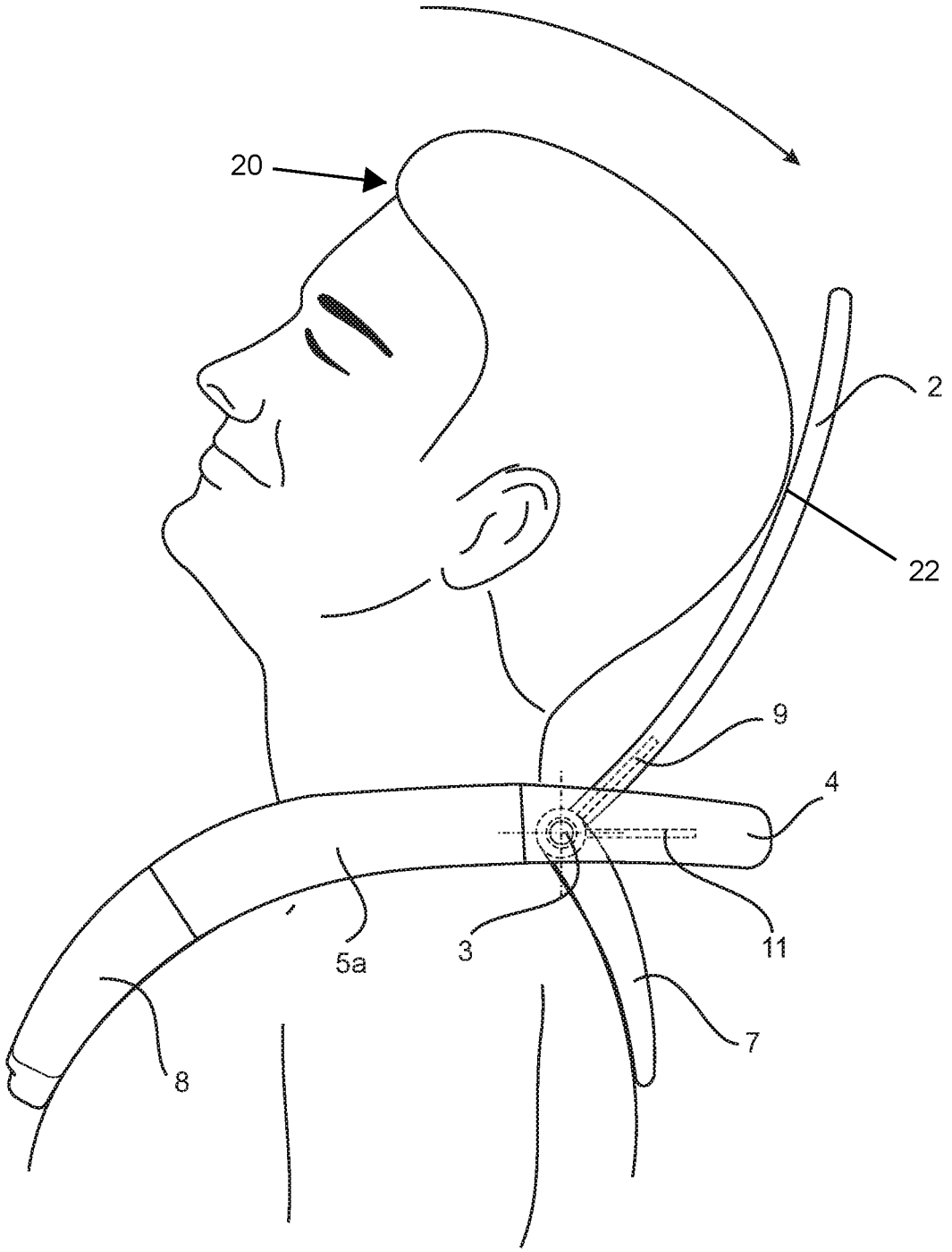
FIG. 11 shows a side view of the apparatus shown in FIG. 9 but now in a neck contracting position.

In an embodiment, the headboard 2 has a width ranging from about 150 mm to about 200 mm, and a length ranging from about 150 mm to about 300 mm. In an embodiment, a width of the headboard 2 is about 150 mm. In an embodiment, a length of the headboard 2 is about 180 mm, 220 mm or 280 mm. Typically, taller user's will require a longer headboard 2 compared with shorter users. In an embodiment, the headboard 2 is curved to define a concave region. The concave region faces towards an in-use front side of the apparatus 1 when the headboard 2 is in the exercise position so that a back of a head of a user engages with the concave region as best shown in FIG. 9 to FIG. 11. In some embodiments the surface of the headboard 2 that engages with the user's head, such as the concave region, is provided with a soft and hard-wearing material, such as fabrics, that helps to reduce the amount of friction between movement of the head against the headboard 2 in use of the apparatus 1. This may help to make movement of the headboard smooth and comfortable when a user uses the apparatus 1. The surface of the headboard 2 may be covered with leather, vinyl, plastic, fabrics and other materials that are smooth and soft. In an embodiment, the headboard is made from wood, stainless steel, steel, aluminium, rubber, plastic and/or composites.

The embodiments of the apparatus shown in the Figures has the back support 7 being U-shaped where ends of the U-shape are pivotably connected to the stabiliser section 4. The stabiliser is provided with two recesses. The two recesses receive the ends of the U-shape. Each recess has two opposed sidewalls extending transversely from a surface of the stabiliser section 4 towards an interior of the stabiliser section 4, a wall spanning between the two sidewalls, and a floor. In some embodiments the floor is curved. One or both of the sidewalls is provided with an indent and one or more faces of the U-shape have a protrusion that is accommodated in the indent. Engagement of the protrusions and indents provides a friction fit that allows the back support 7 to be removeably fixed to the stabiliser section 4 and so that the back support 7 can pivot about an axis defined by the protrusions. In some embodiments the sidewalls are provided with the protrusions and the ends of the back support 7 are provided with indents. In an embodiment, the back support 7 has a width ranging from about 180 mm to about 220 mm, such as 200 mm, and a length (i.e. a direction extending away from the pivot point) ranging from about 80 mm to about 130 mm, such as about 110 mm. In an embodiment, a thickness of the apparatus 1 extending from an upper surface to a lower surface is about 70 mm to about 100 mm, such as about 80 mm, when the headboard 2 is in the collapsed position and back support 7 is in the storage position.

In an embodiment, the back support 7 rests against an edge formed between the wall spanning between the two sidewalls and an exterior surface of the stabiliser section 4. The edge helps to limit the rotation of the back support 7. When the back support 7 abuts the edge, the back support 7 is in the brace position. In an embodiment, an angle formed between the exterior surface of the stabiliser section 4 and the back support 7 ranges from about 55 degrees to about 70 degrees. In some embodiments an abutment member is provided to abut the back support 7 to limit rotation of the back support 7. The abutment member may be adjustable.

The function of the back support 7 is to support the apparatus 1 in use, so the back support 7 can have many different configurations and orientations. Although the back support is shown in the Figures as being U-shaped, the back support 7 is not limited to the embodiments shown in the Figures.

The spring hinge 3 is formed from two spring leafs that pivot relative one another. The spring hinge 3 has a first leaf in the form of rear spring hinge leaf 11 that connects to the stabiliser section 4 and a second leaf in the form of top spring hinge leaf 9 that connects to the headboard 2. In the embodiments of the apparatus shown in the Figures, the stabiliser section 4 has a first hinge recess extending from an in-use front surface, such as a front wall, of the stabiliser section 4 towards an in-use rear surface, such as a back wall, of the stabiliser section 4. The rear spring hinge leaf 11 is received in a second hinge recess in the stabiliser section 4. In some embodiments the rear spring hinge 11 is removably fixed in the second hinge recess in the stabiliser section 4, for example by an interference fit, a detent mechanism or spring-actuated locking mechanism that allows the rear spring hinge leaf 11 to be withdrawn from the cavity. In some embodiments the rear spring hinge leaf 11 is secured to the stabiliser section 4 using one or more fasteners and/or adhesives.

The second hinge recess in the headboard 2 extends from an edge that is proximal to the spring hinge 3 along a longitudinal direction of the headboard 2 towards an edge of the headboard 2 that is distal to the spring hinge 3.

The top spring hinge leaf 9 is received in the second hinge recess in the headboard 2. In some embodiments the top spring hinge 9 is removably fixed in the second hinge cavity in the headboard 2, for example by an interference fit, a detent mechanism or spring-actuated locking mechanism that allows the top spring hinge leaf 9 to be withdrawn from the cavity. In some embodiments the top spring hinge leaf 9 is secured to the headboard 2 using one or more fasteners and/or adhesives.

Having the rear spring hinge leaf 11 being removably fixed in the first hinge recess in the stabiliser section 4 allows the spring hinge 3 to be replaced, for example for a new spring with a higher resistance or to replace a worn spring hinge. Having the top spring hinge leaf 9 being removably fixed in the second recess in the headboard 2 allows the headboard 2 to be replaced, for example when a different sized headboard is required by a user.

As the headboard moves from the exercise position to the collapsed position, the rear spring hinge leaf 11 and the top spring hinge leaf 9 move towards a position being arranged co-planar relative one another, as best shown in FIG. 5. Conversely, as the headboard 2 moves from the collapsed position to the exercise position the rear spring hinge leaf 11 and the top spring leaf 9 move away from a co-planar arrangement more towards a perpendicular arrangement relative one another, as best shown in FIG. 6. It should be appreciated that the description of co-planar and perpendicular arrangements is only exemplary and that spring hinge leafs will generally always be arranged transverse relative one another where an angle formed between the planes of the two spring hinge leafs changes as the headboard 2 moves between the collapsed position to the exercise position.

Figure 4:
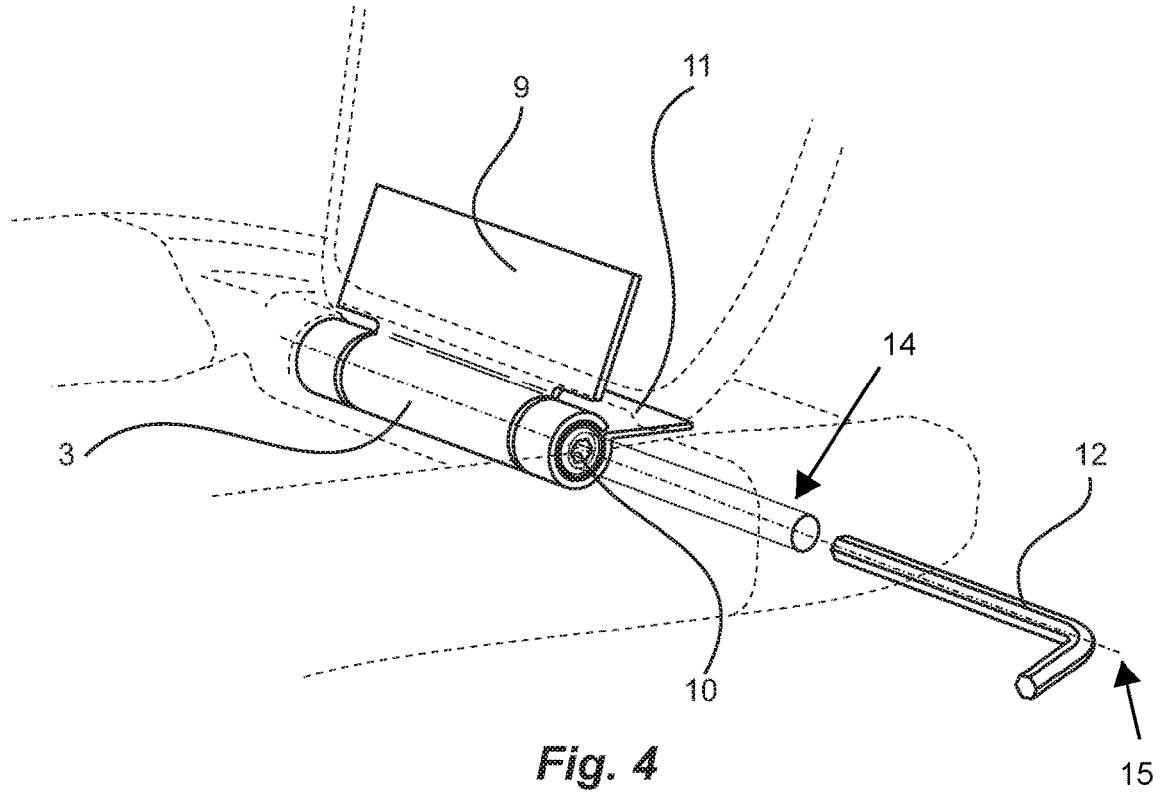
FIG. 4 shows a cut away of an embodiment of an apparatus showing internal components of the apparatus.

In an embodiment the spring hinge 3 has a spring tension adjuster. In the embodiment shown in FIG. 4, the spring tension adjuster is in the form of a rotatable cap 10 having a hex thread. Rotation of the rotatable cap 10 increases or decreases a tension of the spring which will either increase or decrease the bias force of the spring hinge 3 and thus the resistance to movement of the headboard 2. In the embodiment of the apparatus 1 shown in FIG. 4, a channel 14 extends through a side region of the stabiliser section 4. The channel 14 has a proximal end located adjacent the rotatable cap 10 and a distal end opposite the proximal end that opens out to a side face of the apparatus 1. In the embodiment of FIG. 4 the side face is the right-side face, but the channel could be positioned on the left-hand side of the stabiliser section 4 so that the channel 14 opens out to a left face of the apparatus. The channel 14 is sized to receive a tool. In the embodiment shown in FIG. 4, the tool is an Allen key that can pass through the channel 14 to engage with the hex thread of the rotatable cap 10. When the Allen key is engaged with the rotatable head 10, a user can rotate the Allen key to rotate the rotatable cap 10 clockwise or counter-clockwise to increase or decrease a tension of the spring hinge 3. In an embodiment, the channel 14 has a longitudinal axis that extends along an axis defined by the spring hinge 3, such as axis 15 shown in FIG. 4.

The type of the spring tension adjuster is dependent upon the type of spring hinge, and in some embodiments the spring tension adjuster requires access and adjustment from a tool that extends at an angle transverse the axis of rotation to adjust the tension of the spring hinge. In these embodiments, the direction of the longitudinal axis of the channel 14 will be axially aligned with an angle required by a tool to adjust the spring tension adjuster. For example, the channel 14 in some embodiments can extend from the back wall towards the spring hinge 3, such as along a plane of the rear spring hinge leaf 11.

The Figures show the rear spring hinge leaf 11 being received in the recess in the stabiliser section 4 and the top spring hinge leaf 9 being received in the recess in the headboard 2. However, the disclosure is not limited to such an arrangement. For example, the rear spring hinge leaf 11 in some embodiments can be secured to a top surface of the stabiliser section 4 and to a surface of the headboard 2. The hinge 3 may be secured to the stabiliser section 4 and the headboard 2 using adhesives and/or fasteners. The use of fasteners may allow the spring hinge 3 to be removed, for example to be replaced with a new spring hinge.

Use of the apparatus 1 is best described with reference to FIG. 9 to FIG. 11. To use the apparatus 1, a user 20 will move the back support 7 from the storage position to the brace position. The user 20 will then pass their head through the opening formed between the arms 5. If the opening is not large enough, the user 20 may need to move the arms apart to increase a size of the opening, as shown in FIG. 5. As the head of the user 20 is passed through the opening, their head will abut the headboard 2 at abutment point 22 and cause the headboard 2 to move from the collapsed position towards the exercise position. When the apparatus 1 is positioned over the shoulders of the user 20, the back support 7 engages with the upper back region of the user, such as around the trapezius muscle indicated at region 24, and the arms rest on the shoulders and extend down over the chest region and the headboard 2 will extend generally along a length of the neck. For example, when the user 20 is upright, the headboard 2 will extend generally vertically, as shown in FIG. 9.

As the headboard 2 is biased towards the collapsed position, when the user 20 has placed the apparatus into position, the user 20 will need to contract the muscles in their neck and head to maintain the headboard in the position shown in FIG. 9. The user can then rotate their head forward so that their chin moves towards their chest in a direction of the bias provided by the spring hinge 3, as shown in FIG. 10. The bias on the headboard 2 helps to stretch out the muscles in the beck. The abutment point 22 moves towards an end of the headboard 2 when the user 20 rotates their chin towards their chest. When the user 20 moves their head backwards against the bias to move the head board 2 backwards, as shown in FIG. 11, the headboard 2 creates resistance down the back of the scalp of the user 20 thus exercising the muscles at the back of the scalp and the back of the neck. The abutment point 22 moves down the headboard 2 towards the spring hinge 3 when the user 20 rotates their head backwards away from the chest. The back support 7 helps to keeps the apparatus 1 secure and in position while the user pushes back against the headboard 2. Some users may grasp the arms 5 and/or the arm stabiliser 8 during use of the apparatus 1 to help stabilise the apparatus 1 on the shoulder and neck. When the user 20 removes the apparatus 1, the headboard 2 moves back towards the collapsed position due to the bias of the spring hinge 3. When the back support 7 is pivotably attached to the stabiliser section 4, the user can then rotate the back support 7 back to the storage position.

Throughout this disclosure, terms such as upper, lower, forward, back, and so on are used in relation to an in-use orientation of the apparatus to describe the relative arrangement of the features of the apparatus, but these terms do not limit the apparatus to a specific orientation.

The apparatus of the disclosure can be embodied in many forms, and the following exemplary embodiments are just some of the possible embodiments of the disclosed apparatus.

Embodiment 1: A scalp muscle exercise apparatus to create resistance to the back of the scalp comprising, a neck collar with an opening in the middle for a person to put their head through, a spring hinge and a headboard that is positioned at the back of the head.

Embodiment 2: A scalp muscle exercise apparatus according to embodiment 1, wherein the tension of the said spring hinge is adjustable and may be increased or decreased by the user.

Embodiment 3: scalp muscle exercise apparatus according to embodiment 1, wherein the said spring hinge has two leafs.

Embodiment 4: A scalp muscle exercise apparatus according to embodiment 3, wherein one of the said spring hinge leafs is secured inside the said headboard by releasable retaining means.

Embodiment 5: A scalp muscle exercise apparatus according to embodiment 4, wherein the said spring hinge leaf provides a closing force to the said headboard that can be increased or decreased by the user.

Embodiment 6: A scalp muscle exercise apparatus according to embodiment 1, wherein the said headboard is preferably curved to contour the back of the user's head.

Embodiment 7: A scalp muscle exercise apparatus according to embodiment 1, wherein the said headboard is preferably made from materials of wood, stainless steel, steel, aluminium, rubber or plastic.

Embodiment 8: A scalp muscle exercise apparatus according to embodiment 7, wherein the said headboard materials may have soft hard-wearing fabrics applied to the inner surface of the said head board so as the friction from the up and down movement of the users head on the said headboard is smooth and comfortable for the user.

Embodiment 9: A scalp muscle exercise apparatus according to embodiment 3, wherein one of the said spring hinge leafs is secured inside the said neck collar by releasable retaining means.

Embodiment 10: A scalp muscle exercise apparatus according to embodiment 9, wherein the said retaining means includes a frictional force between the said neck collar and the spring hinge leaf, a detent mechanism or a spring-loaded actuator.

Embodiment 11: A scalp muscle exercise apparatus according to embodiment 9, wherein the said spring hinge leaf can be removed from the said neck collar allowing the entire spring hinge apparatus to be removed and replaced.

Embodiment 12: A scalp muscle exercise apparatus according to embodiment 1 wherein the said neck collar has a head opening formed for the user to put their head through.

Embodiment 13: A scalp muscle exercise apparatus according to embodiment 1, wherein the said neck collar has a said back support to anchor the said neck collar at the back of the neck and upper torso of the user so as to stabilise the said neck collar when tension is being applied by the said head board being pushed back to upright position by the user.

Embodiment 14: A scalp muscle exercise apparatus according to embodiment 13, wherein the said back support folds inward when not in use in order to reduce size and be more compact and travel friendly.

Embodiment 15: A scalp muscle exercise apparatus according to embodiment 1, wherein the said neck collar has flexible said rubber arms that are positioned on the chest of a user that contour to the different shapes and sizes of user chests.

Embodiment 16: A scalp muscle exercise apparatus according to embodiment 15, wherein the said rubber arms are attached to a said rubber arm stabiliser to keep the rubber arms in a stable and uniform position on the user's chest.

Embodiment 17: A scalp muscle exercise apparatus according to embodiment 16, wherein the said rubber arm stabiliser has a latch to keep the said rubber arm stabiliser together.

Embodiment 18: A scalp muscle exercise apparatus according to embodiment 15, wherein the said rubber arms are made of rubber, plastic or any flexible material that can stretch in order to make the opening of the said neck collar wider so any size head can fit through.

Embodiment 19: A scalp muscle exercise apparatus according to embodiment 1, wherein the said neck collar has a said Allen key hole on the side to allow the said Allen key to be put through to adjust the tension of the said spring hinge.

Embodiment 20: A scalp muscle exercise apparatus according to embodiment 16, wherein the user can hold the said rubber arm stabiliser with their hands to keep the said neck collar in a stable position while the user is performing the exercises with the scalp muscle exercise apparatus.

Embodiment 21: A scalp muscle exercise apparatus according to embodiment 4, wherein the said retaining means include a frictional force between the said spring hinge leaf and the said head board, a detent mechanism or a spring-loaded actuator.

Embodiment 22: A scalp muscle exercise apparatus according to embodiment 1, wherein the said headboard is straight to target the top of the of the user's head.

Embodiment 23: A scalp muscle exercise apparatus according to embodiment 8, wherein the said fabrics are preferably leather, vinyl, plastic and other fabrics that are smooth and soft.

Embodiment 24: A scalp muscle exercising apparatus according to embodiment 19, wherein the said Allen key hole may also be on the top, back, underneath, or front of the neck collar depending what type of said spring hinge is used with the invention.

Embodiment 25: A scalp muscle exercising apparatus according to embodiment 14, wherein the said back support when open is secured to the said spring hinge stabiliser by releasable retaining means including a frictional force between the said back support and the said spring hinge stabiliser, a detent mechanism or a spring-loaded actuator.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments.

The invention claimed is:

1. An apparatus for exercising muscles of a head and/or neck of a user, comprising:

a harness configured to fit over the user's head and engaged with an upper portion of the user;

a plate pivotably connected to the harness, the plate being movable between a collapsed position and an exercise position where a back of the head of the user is configured to engage with the plate; and a biasing member that biases the plate towards the collapsed position, wherein the harness comprises a support having a pair of extending arms that extend from the support, and a brace connected to the support.

2. The apparatus as claimed in claim 1, wherein at least a portion of the arms are covered by the plate when the plate is in the collapsed position.

3. The apparatus as claimed in claim 1, wherein the brace is pivotably connected to the support so as to be movable between a storage position and a brace position, wherein the brace extends from the support in a direction along the arms when the brace is in the storage position.

4. The apparatus as claimed in claim 1, wherein the pair of arms are spaced apart from one another to define an opening therebetween, wherein the arms are movable away from one another to increase a size of the opening to allow the opening to receive the head of the user.

5. The apparatus as claimed in claim 4, wherein each arm of the pair of arms comprises a resiliently deformable section that allows the arms to be moved away from one another to increase the size of the opening.

6. The apparatus as claimed in claim 5, wherein each resiliently deformable section extends along more than 50% of a length of the arm.

7. The apparatus as claimed in claim 6, wherein the resiliently deformable sections extend from the support.

8. The apparatus as claimed in claim 4, each arm of the pair of arms comprise a rigid end segment, wherein the rigid end segments are configured to selectively abut one another to maintain a minimum size of the opening.

9. The apparatus as claimed in claim 8, wherein the rigid end segments are provided with a locking mechanism to lock the end segments together.

10. The apparatus as claimed in claim 9, wherein the locking mechanism comprises:

a protrusion extending from one rigid end segment or the rigid end segments; and a recess provided in the other end segment, the protrusion having a complementary shape to the recess so that the protrusion is configured to he received in the recess as an interference fit.

11. The apparatus as claimed in claim 1, wherein the biasing member is a spring hinge having a first spring leaf and a second spring leaf, the first spring leaf being connected to the support and the second spring leaf being connected to the plate.

12. The apparatus as claimed in claim 11, wherein the support is provided with a first hinge recess that can receive the first spring leaf and the plate is provided with a second hinge recess that can receive the second spring leaf.

13. The apparatus as claimed in claim 12, wherein the second hinge recess extends from an edge of the plate along a longitudinal direction of the plate, and wherein the first hinge recess extends from an in-use front surface of the support towards an in-use rear surface of the support.

14. The apparatus as claimed in claim 12, wherein the first leaf spring is removably fixed to the first hinge recess and/or the second leaf spring is removably fixed to the second hinge recess.

15. The apparatus as claimed in claim 11, wherein the spring hinge has a spring hinge tension adjuster that allows a tension of the spring hinge to be adjusted, and wherein the support is provided with a channel extending through the support, the channel having a proximal end positioned near the spring hinge tension adjuster and a distal end opposite the proximal end, wherein a tool is configured to pass through the channel to engage with the spring hinge tension adjuster to adjust the tension of the spring.

16. The apparatus as claimed in claim 15, wherein the channel is aligned along an axis of the spring hinge.

17. The apparatus as claimed in claim 1, wherein the arms extend from a same surface of the support, wherein the arms are positioned on opposed side edges of the surface.

18. The apparatus as claimed in claim 1, wherein the plate is curved to define a concave region, wherein in use a back of the head or the user contacts the concave region.

19. The apparatus as claimed in claim 1, wherein the brace is U-shaped and ends of the U-shape are pivotably connected to the support.

20. The apparatus as claimed in claim 1, wherein the brace is connected to the support via a friction fit.

21. The apparatus as claimed in claim 1, wherein:

the support comprises a connecting recess having a sidewall that extends from a surface of the support towards an opposed surface of the support;

one of the sidewall and the brace is provided with a protrusion and the other of the sidewall and brace is provided with an indent sized to receive the protrusion;

when the protrusion is received in the indent, the brace is removably attached to the support.

* * * * *